US006918583B2

(12) United States Patent
Asada et al.

(10) Patent No.: US 6,918,583 B2
(45) Date of Patent: Jul. 19, 2005

(54) SHEET FEEDER

(75) Inventors: Tetsuo Asada, Kuwana (JP); Takatoshi Takemoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 162 days.

(21) Appl. No.: 10/618,625

(22) Filed: Jul. 15, 2003

(65) Prior Publication Data

US 2004/0012139 A1 Jan. 22, 2004

(30) Foreign Application Priority Data

Jul. 18, 2002 (JP) ..... 2002-209304

(51) Int. Cl.[7] ..... B65H 7/08
(52) U.S. Cl. ..... 271/110
(58) Field of Search ..... 271/110

(56) References Cited

U.S. PATENT DOCUMENTS 5,228,673 A * 7/1993 Osonoe ..... 271/10.01
6,019,362 A * 2/2000 Yazawa ..... 271/4.01
6,352,256 B1 * 3/2002 Hsieh ..... 271/110
6,540,220 B2 * 4/2003 Kuo et al. ..... 271/118
6,672,581 B2 * 1/2004 Lee et al. ..... 271/164

FOREIGN PATENT DOCUMENTS

JP A 1-291965 11/1989

* cited by examiner

*Primary Examiner*—Donald P. Walsh
*Assistant Examiner*—Kenneth W. Bower
(74) *Attorney, Agent, or Firm*—Oliff & Berridge, PLC

(57) ABSTRACT

A sheet feeder includes a sheet mounting plate, pick-up roller, drive motor and transmission device to prevent an excessive load from being applied to a pick-up roller when no sheets are mounted on a sheet mounting plate. When the sheets on the sheet mounting plate run out, a sheet detecting actuator of the sheet feeder fits into an opening formed on the sheet mounting plate. Accordingly, a protrusion of a drive actuator slides along a groove formed on the sheet detecting actuator, which causes the drive actuator and a drive interrupting boss to move. With this structure, transmission of drive force to the pick-up roller is interrupted.

12 Claims, 12 Drawing Sheets

SHEET FEEDER

BACKGROUND OF THE INVENTION

1. Field of Invention

The invention relates to a sheet feeder, for use in image forming apparatuses, such as copying machines, printers, and facsimile machines. In particular, the invention relates to a sheet feeder that prevents damages or malfunction of a pick-up roller and a drive system of the sheet feeder by restricting load torque applied when mounted sheets run out.

2. Description of Related Art

As disclosed in, for example, Japanese Laid-Open Patent Publication No. 1-291965, a known sheet feeder for use in, for example, facsimile machines feeds sheets with a pick-up roller by making the pick-up roller contact a stack of a plurality of the sheets and rotating the pick-up roller. Such sheet feeder generally includes a sheet mounting plate that mounts sheets thereon, a pick-up roller disposed so as to face the sheet mounting plate for feeding the sheets mounted on the sheet mounting plate in a sheet feeding direction, an urging member that urges the sheet mounting plate or the pick-up roller in such a direction that the sheet mounting plate and the pick-up roller contact each other, a motor that produces a rotating force, and a plurality of gears that transmit the rotation force of the motor to the pick-up roller. In the above-described known sheet feeder, the pick-up roller contacts the sheets on the sheet mounting plate with an urging force of the urging member. As the rotation of the motor is transmitted to the pick-up roller through the plurality of the gears, the pick-up roller rotates to feed the sheets.

In the above-described known sheet feeder, when the sheets on the sheet mounting plate run out, the pick-up roller contacts the sheet mounting plate with an urging force of the urging member. As the pick-up roller is rotated in this condition, an excessive load is applied to the pick-up roller. Due to the application of the excessive load, motor malfunction that causes unfavorable noises and damages of the sheet feeder may occur.

SUMMARY OF THE INVENTION

To solve the above-described problems, one aspect of the invention is to provide a sheet feeder that restricts excessive loads to be applied to a pick-up roller when sheets on a sheet mounting plate run out.

To achieve this aspect, a sheet feeder according to the invention may include a sheet mounting plate that mounts a stack of sheets thereon, a pick-up roller provided so as to face the sheet mounting plate for picking up and feeding one sheet at a time from the stack of sheets mounted on the sheet mounting plate by rotating the pick-up roller with the pick-up roller and the sheet contacting each other, a drive motor that generates a drive force, and a transmission device that transmits the drive force from the drive motor to the pick-up roller. The transmission device may include a first drive force transmission device that constantly cooperates with a rotation shaft of the pick-up roller, a switching device that switches between a first condition where a drive force from the drive motor is transmittable to the first drive force transmission device and a second condition where the drive force from the drive motor is not transmittable to the first drive force transmission device, a second drive force transmission device that transmits the drive force from the drive motor to the switching device, and an actuator that moves in accordance with the presence or absence of the sheets on the sheet mounting plate and sets the switching device in the second condition when no sheets are mounted on the sheet mounting plate.

In the sheet feeder according to the exemplary embodiment of the invention as described above, the transmission device may transmit the drive force from the drive motor, through the first drive force transmission device and the second drive force transmission device, to the pick-up roller provided so as to face the sheet mounting plate that mounts the stack of sheets thereon. One sheet at a time may be picked up and fed from the stack of sheets by rotating the pick-up roller such that the pick-up roller and the sheet contact each other. The switching device switches between the first condition and the second condition. When no sheets are mounted on the sheet mounting plate, the actuator may set the switching device in the second condition, so that the drive force transmitted by the transmission device may be interrupted. In other words, when no sheets are mounted on the sheet mounting plate, the drive force is not transmitted to the pick-up roller, so that an application of an excessive load torque to the pick-up roller, as well as noises generated due to the motor malfunction, may be prevented.

In the above-described sheet feeder, the switching device may include the following: a first gear that receives, from the second drive force transmission device, the drive force transmitted from the drive motor; a link member that rotatably supports the first gear on one end thereof, and is rotatable in association with and in a same direction as the rotation of the first gear; and a second gear that is rotatably supported on the other end of the link member and receives the drive force transmitted from the first gear. The second gear may engage with the first drive force transmission device in the first condition to transmit the drive force to the first drive force transmission device and may be separated from the first drive force transmission device in the second condition. The actuator may include a maintaining device that maintains a condition where the second gear is separated from the first drive force transmission device when no sheets are mounted on the sheet mounting plate.

At any time, including when the first gear receives the drive force from the drive motor, the second gear receives the drive force from the first gear and the link member rotatably supports the first and second gears, the second condition may be set by the switching device by separating, through the link member, the second gear from the first drive force transmission device. The maintaining device of the actuator may maintain the condition where the second gear is separated from the first drive force transmission device when no sheets are mounted on the sheet mounting plate. Accordingly, connection to the pick-up roller to transmit the drive force may be disconnected during a non-sheet pick-up operation, and the actuator may maintain the drive-force non-transmittable condition by using simple structures.

In the sheet feeder, the actuator preferably pivots about an axis disposed above the center of gravity of the actuator. The axis may be disposed at a position that faces the sheet mounting plate. The actuator may then pivot about the axis and a portion thereof below the center of gravity and fall toward the sheet mounting plate when no sheet is mounted on the sheet mounting plate. The actuator may also control the rotation of the pick-up roller. In addition, the actuator may prevent the sheet from buckling by contacting the sheet on the sheet mounting plate.

Further, the actuator may include a sheet detecting actuator that detects the presence or absence of the sheets on the sheet mounting plate, and a drive actuator that sets the switching device in the second condition. Accordingly, the drive force transmission may be controlled with the simple structure of the actuator and with the reduced number of components to be used.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
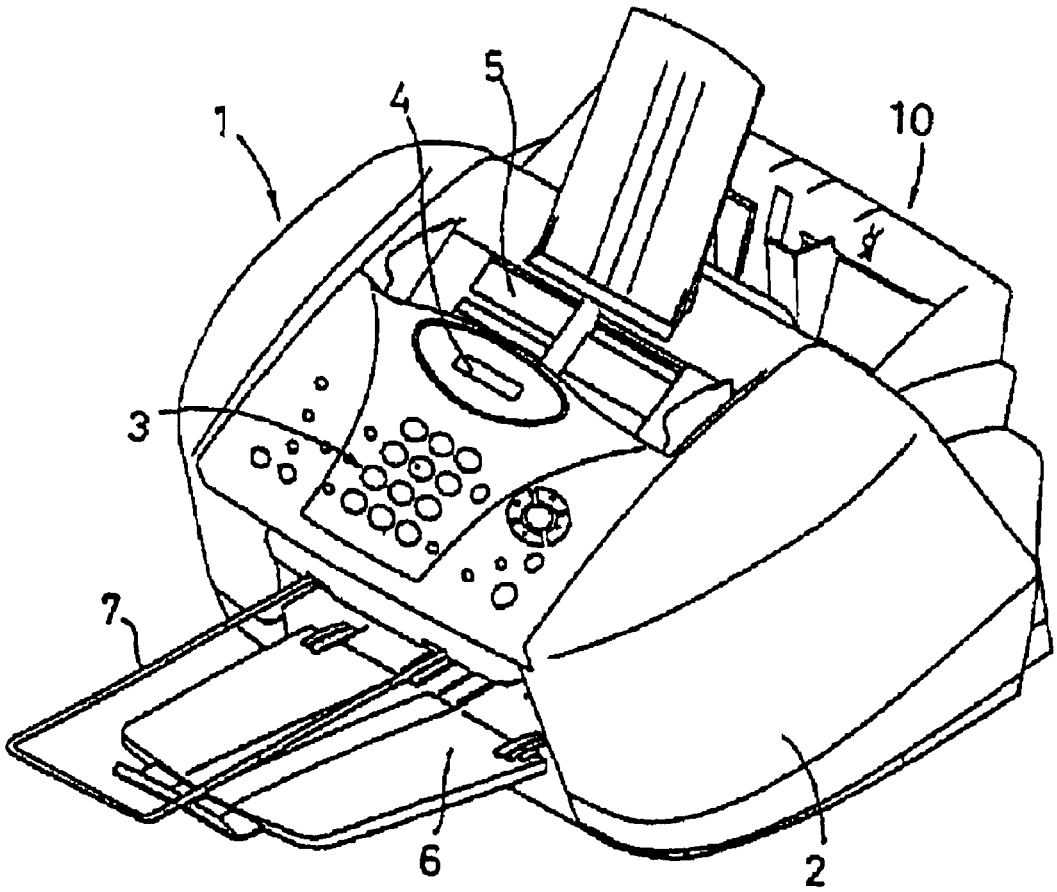
FIG. 1 is a perspective view of a multi-function image forming apparatus including a sheet feeder according to an embodiment of the invention.

FIG. 1 shows a multi-function image forming apparatus 1 including a sheet feeder 10 according to an embodiment of the invention. The multi-function image forming apparatus 1 has various functions, such as facsimile functions, printer functions, copy functions, and scanner functions.

As shown in FIG. 1, the multi-function image forming apparatus 1 is provided with a case-like apparatus body 2. Provided at an upper portion of the apparatus body 2 is a control panel 3 including various operation keys 3*a* (in FIG. 2), such as numeric keys numbered 0 to 9 and a start key. Various operations may be performed as a user presses the operation keys 3*a* provided on the control panel 3. Provided at a rear side of the control panel 3 is a liquid crystal display (LCD) 4 that displays various information, such as setting conditions of the multi-function image forming apparatus 1 and operation messages, when required.

Provided at a rear side of the LCD 4 is a document setting portion 5 on which an original document to be faxed to a remote facsimile machine using the facsimile functions or to be copied using the copying functions may be stacked. The original document positioned on the document setting portion 5 is fed into the apparatus body 2, and an image on the original document is read by a scanner 64 (in FIG. 2). Thereafter, the read original document is discharged from a document discharge portion 7 provided on a front side of the apparatus body 2 below the control panel 3.

Provided at a rear side of the document setting portion 5 is the sheet feeder 10 that mounts a stack of sheets P thereon. A sheet P mounted on the sheet feeder 10 is fed toward an image forming unit 61 (in FIG. 2) of, for example, an ink jet type provided in the apparatus body 2. After an image is formed on the sheet P by the image forming unit 61, the sheet P is discharged onto a sheet discharge portion 6.

Figure 2:
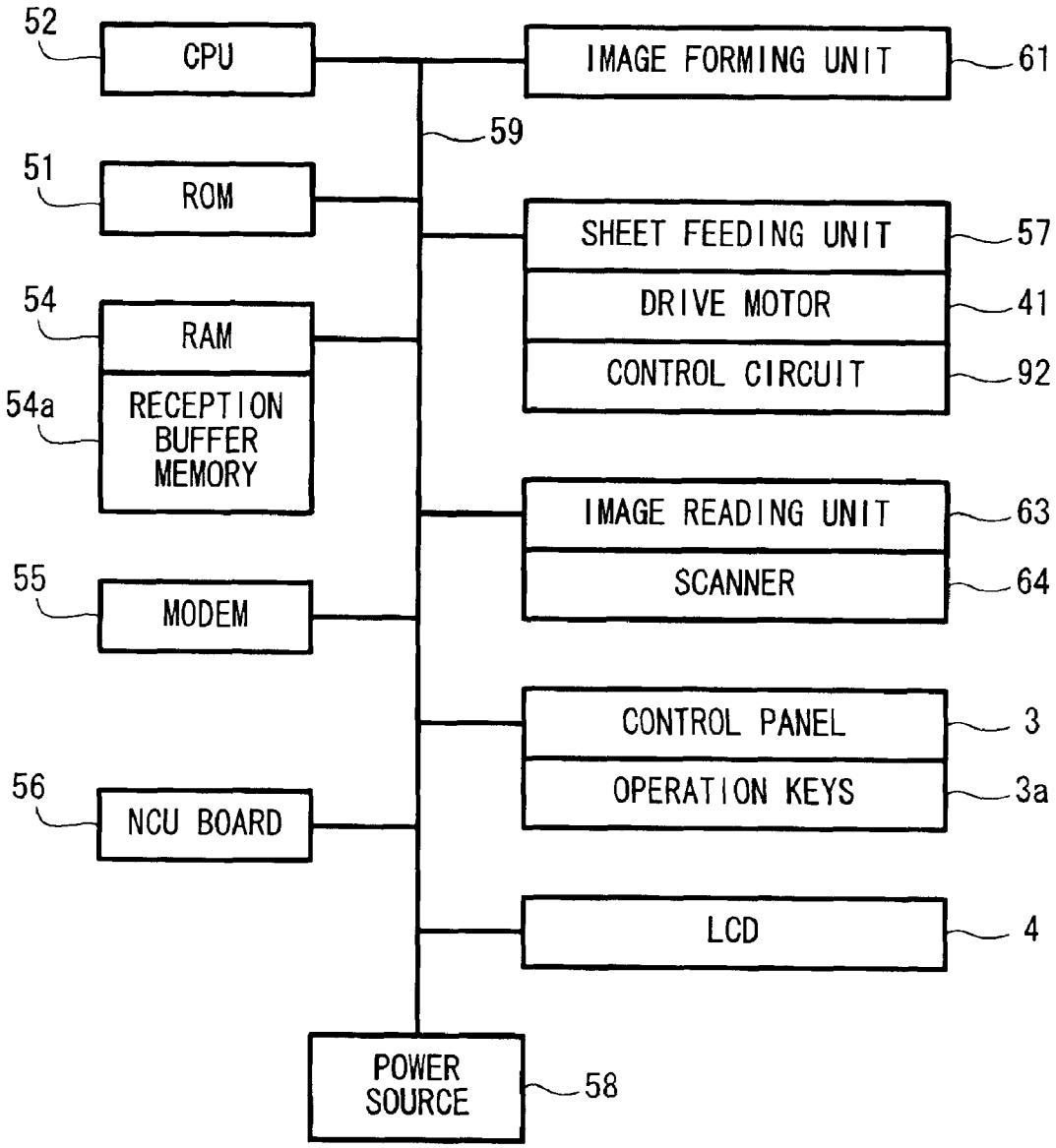
FIG. 2 is a block diagram of a controller that performs various functions of the image forming apparatus.

FIG. 2 is a block diagram of a controller that executes various functions of the image forming apparatus 1. As shown in FIG. 2, the image forming apparatus 1 includes a central processing unit (CPU) 52, a read-only memory (ROM) 51, a random-access memory (RAM) 54, a modem 55, a network control unit (NCU) board 56, an image forming unit 61, a sheet feeding unit 57, an image reading unit 63, the control panel 3, and a power source 58. The CPU 52 performs various controls and calculations. The ROM 51 stores control programs for instructing various control operations. The RAM 54 includes a reception buffer memory 54*a*. The NCU board 56 is for performing network controls for communication with other communication devices. The modem 55 is for sending and receiving communication data to and from other communication devices, through the NCU board 56. The image forming apparatus 61 is, for example, an ink jet type. The sheet feeding unit 57 includes a drive motor 41 that drives rollers for feeding the sheets P and a control circuit 92 that performs drive controls for the drive motor 41. The image reading unit 63 includes a scanner 64 that reads an image on a document. The control panel 3 includes the operation keys 3*a*. The LCD 4 displays, for example, operation messages when necessary. The power source 58 supplies the power to the image forming apparatus 1. The above-described elements are connected to each other through a bus line 59.

Figure 3:
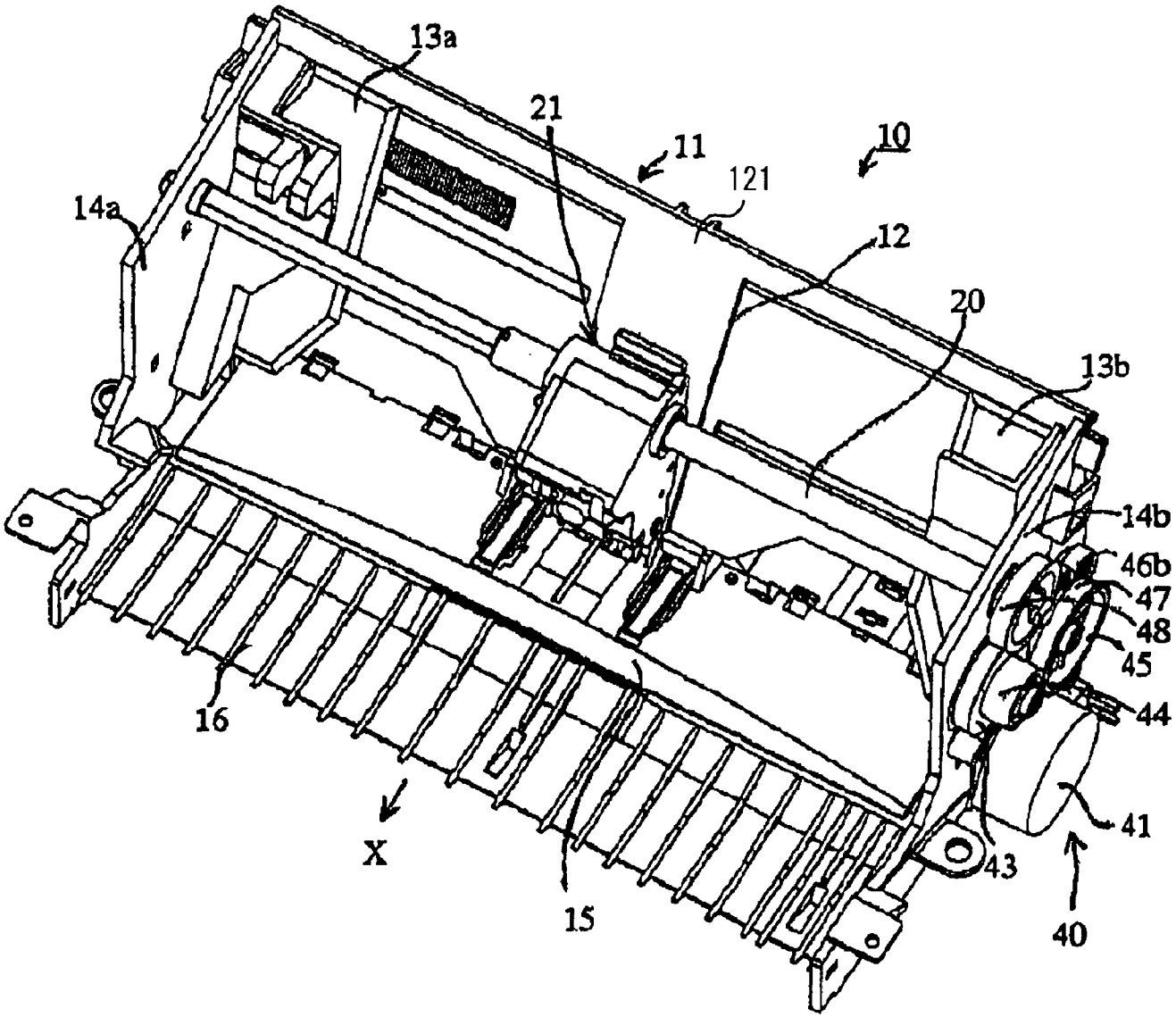
FIG. 3 is a perspective view of the sheet feeder mounted on the image forming apparatus.

The sheet feeder 10 will be described in detail below with reference to FIG. 3. As shown in FIG. 3, the sheet feeder 10 includes a frame 11 received inside the apparatus body 2, a drive mechanism 40 disposed on an end of the frame 11, and a pick-up roller unit 21 that feeds the sheets P in the direction X, by receiving the drive force from the drive mechanism 40.

The frame 11 includes a sheet mounting plate 12, a separation plate 15, a pair of side wall plates 14*a*, 14*b*. The sheet mounting plate 12 supports a stack of the sheets P mounted on a sheet mounting surface 121 provided on an upper face of the sheet mounting plate 12.

Figure 4:
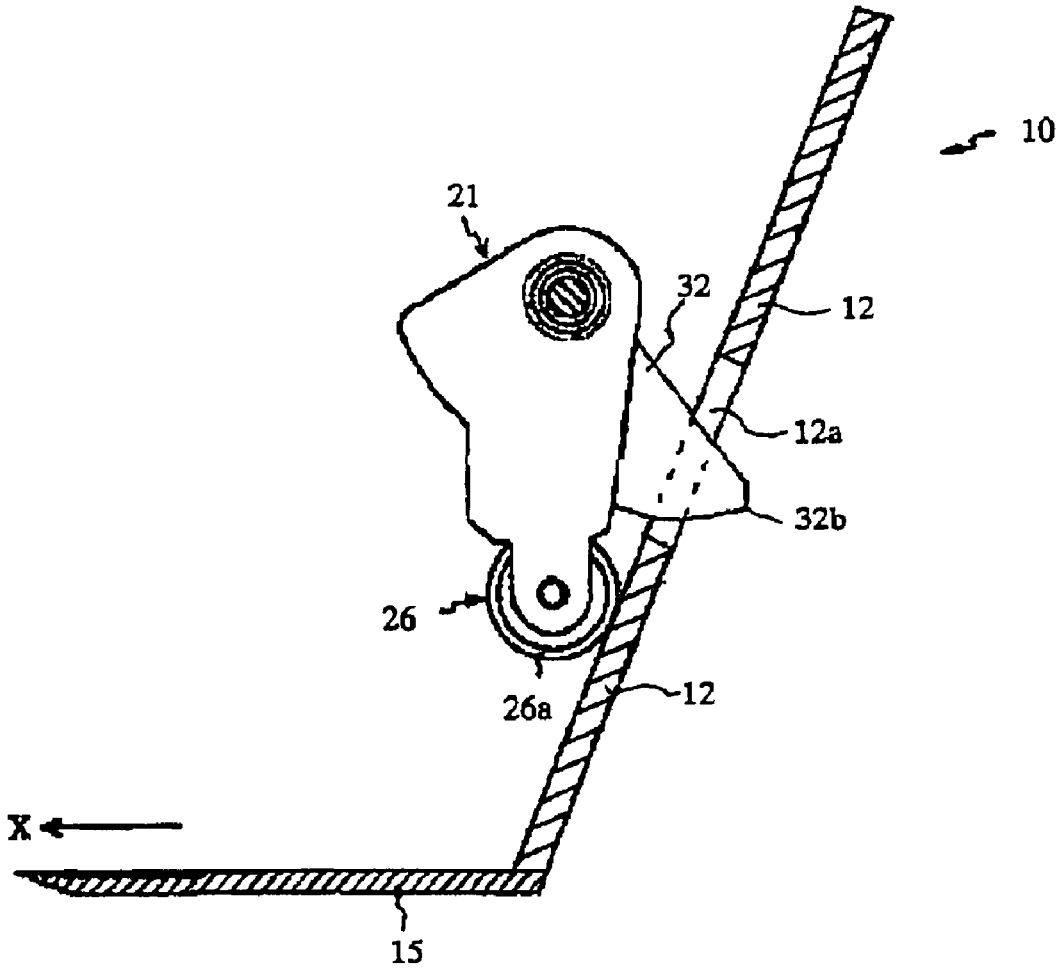
FIG. 4 is a side view of the sheet feeder showing a principal portion thereof.

FIG. 4 shows the sheet mounting plate 12 disposed in such a manner that an upper rear portion of the frame 11 (on the upper side in FIG. 3) and a lower front portion thereof (on the lower side in FIG. 3) are angled. The sheet mounting plate 12 has an opening 12*a* formed in a central portion thereof. The opening 12*a* is provided at a position of the sheet mounting plate 12 where a sheet detecting actuator 32 extending from a rear side of the pick-up roller unit 21 fits therein. As shown in FIG. 4, when no sheets P are mounted on the sheet mounting plate 12, the sheet detecting actuator 32 fits into the opening 12*a*. The separation plate 15 is provided such that an end of the separation plate 15 is connected to an end of the sheet mounting plate 12. The separation plate 15 separates the sheets P mounted on the sheet mounting plate 12 and guides the separated sheets P, one by one, along a guide plate 16 in the direction of arrow X which is toward the image forming unit 61. The separation plate 15 extends in a substantially horizontal direction from a connecting portion, between the separation plate 15 and the sheet mounting plate 12, toward the image forming unit 61 (toward the left front side in FIG. 3). The sheet P mounted on the sheet mounting plate 12 is horizontally guided to the image forming unit 61, along the upper surfaces of the separation plate 15 and the guide plate 16.

The side wall plates 14*a*, 14*b* are disposed with a certain distance therebetween so as to face each other. Sheet guides 13*a*, 13*b* are provided on the sheet mounting plate 12 near the side wall plates 14*a*, 14*b*, respectively. The sheet guides 13*a*, 13*b* are connected by a rack (not shown) and a pinion (not shown) provided for the frame 11. The sheet guides 13*a*, 13*b* are movable in the direction of the width of the sheet mounting plate 12, in association of the movement of the rack and pinion, so as to match the width of the sheet P. The sheets P are mounted on the sheet mounting plate 12 between the sheet guides 13*a*, 13*b*.

The drive mechanism 40 is disposed on an outside surface (right-side surface in FIG. 3) of the side wall plate 14*b* opposite to the side wall plate 14*a*. The drive mechanism 40 includes the drive motor 41 and a plurality of gears 42–48 that transmit the drive force of the drive motor 41. A transmission gear 48 is disposed at an end of a drive shaft 20 that transmits the drive force to the pick-up roller unit 21. Disposed below the transmission gear 48 are six connecting gears 42–47 that are formed of, for example, a resin material into spur gears.

Figure 5:
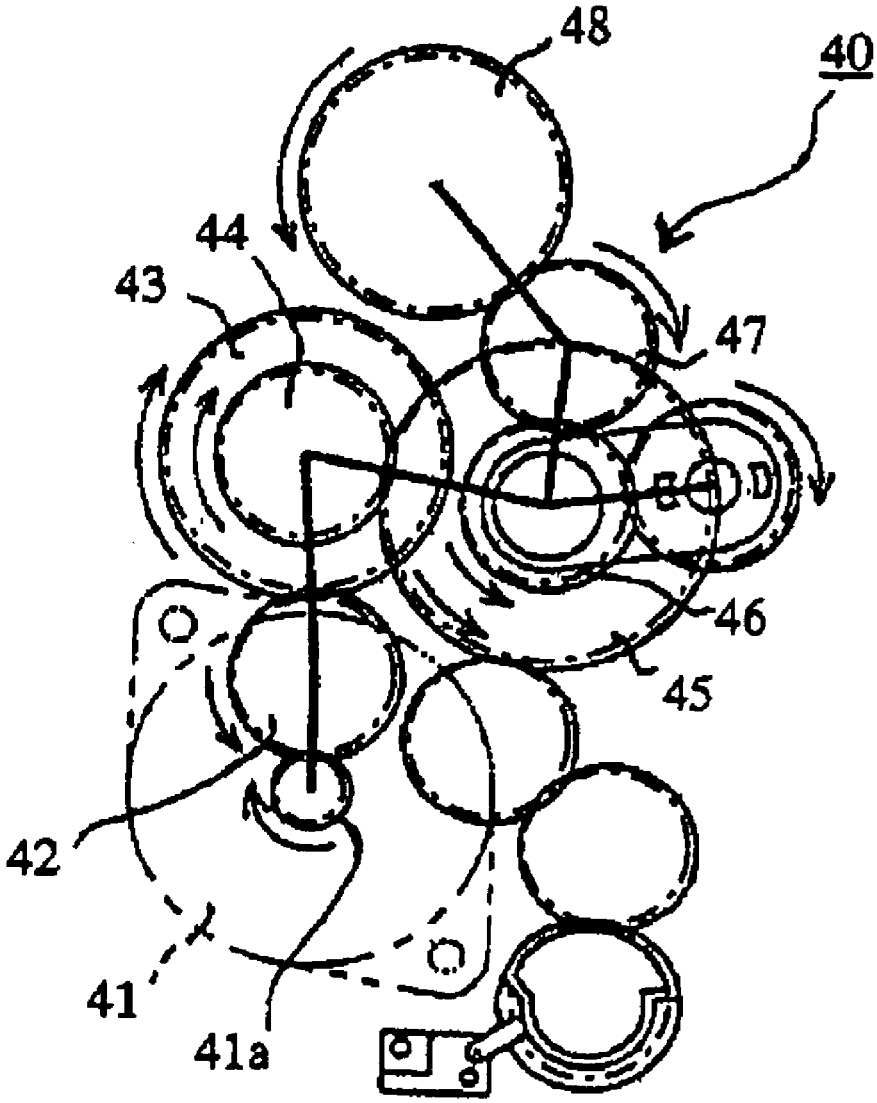
FIG. 5 is a plane view showing an drive unit of the sheet feeder.

The drive mechanism 40 of the sheet feeder 10 will be described in detail below with reference to FIG. 5. In FIG. 5, a pitch circle of each gear 41*a*, 42–48 are indicated by dot-dash lines, and gear teeth provided on an outer periphery of each gear 41*a*, 42–48 are not illustrated. As shown in FIG. 5, the connecting gear 42 is formed to engage with a pinion gear 41*a* mounted on a rotating shaft of the drive motor 41. The connecting gear 42 is engaged with another connecting gear 43, which is concentrically and integrally formed with the gear 44. The connecting gear 44 engages with the connecting gear 45, which is concentrically and integrally formed with the connecting gear 46. The connecting gear 46 engages with the connecting gear 47 that engages with the transmission gear 48.

Rotation of the rotating shaft of the drive motor 41 is transmitted to the transmission gear 48, through the pinion gear 41*a* and the connecting gears 42 through 47. More specifically, as the rotating shaft of the drive motor 41 is rotated, the rotation is transmitted to the pinion gear 41*a* and the connecting gears 42 through 47, in this order, to rotate the gears 41*a*, 42–47. The rotation transmitted to the connecting gear 47 is then transmitted to the transmission gear 48 which is engaged with the connecting gear 47. Further, the rotation transmitted to the transmission gear 48 is transmitted to the drive shaft 20, to rotate the drive shaft 20.

The drive shaft 20 is disposed across the side wall plates 14*a*, 14*b* and rotatably supported by the side wall plates 14*a*, 14*b*. The pick-up roller unit 21 is disposed in a substantially central portion of the drive shaft 20 in an axial direction thereof, as shown in FIG. 3.

The pick-up roller unit 21 will be described in detail below with reference to FIG. 6. The pick-up roller unit 21 drives the pick-up roller 26 by the rotation of the drive shaft 20, and feeds the sheets P mounted on the sheet mounting plate 12 toward the guide plate 16.

Figure 6:
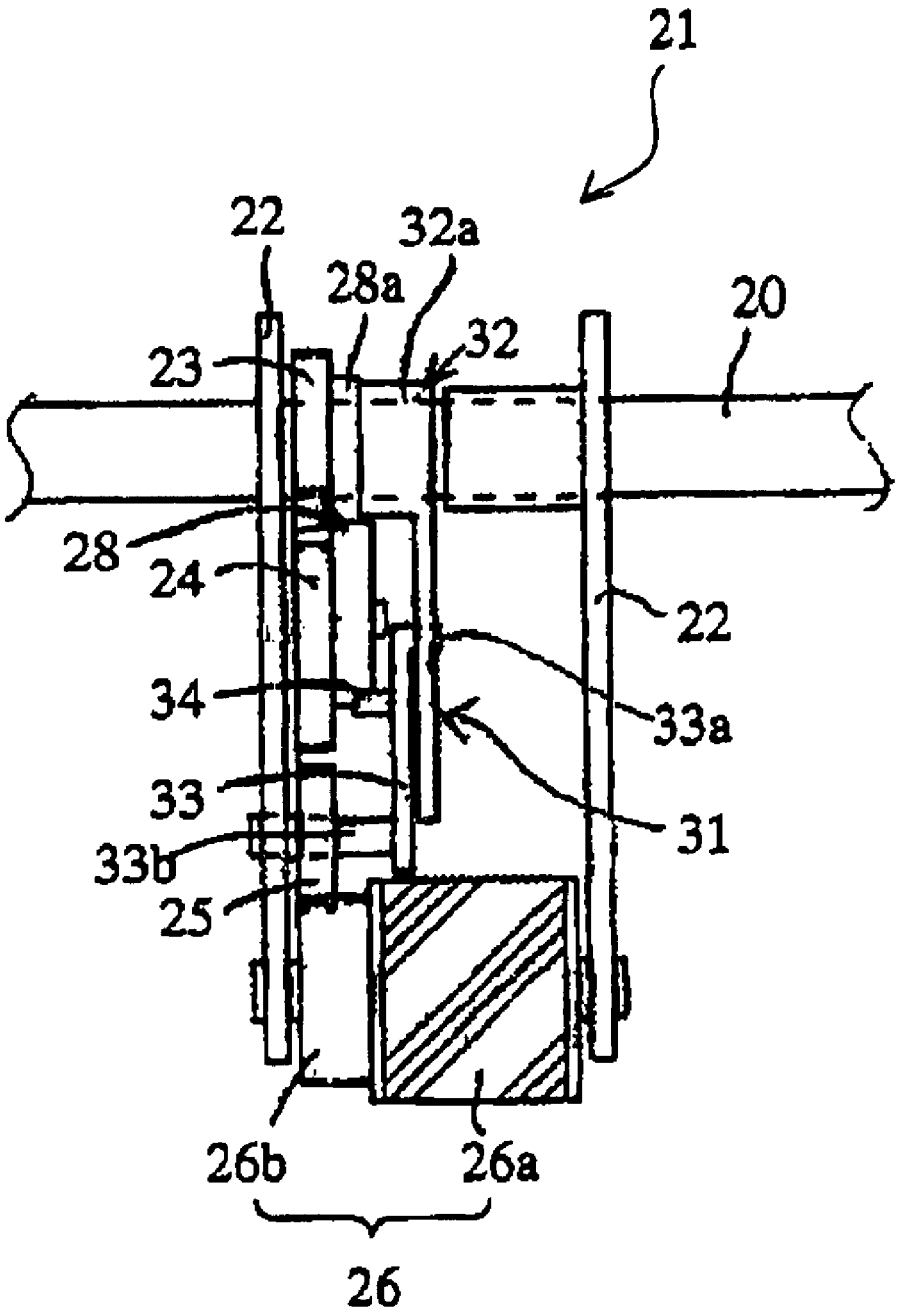
FIG. 6 is a front view of a pick-up roller unit of the sheet feeder, illustrating internal structures thereof.

As shown in FIG. 6, the pick-up roller unit 21 includes a case 22, a drive gear 23, an arm member 28, a clutch gear 24, the pick-up roller 26, an interposed gear 25, and an actuator unit 31 that are disposed inside the case 22. The actuator unit 31 interrupts the transmission of the drive force to the pick-up roller 26 when the sheets P on sheet mounting surface 121 run out.

The gears 23–25, the arm member 28 and the actuator unit 31 are provided, between the drive shaft 20 and the pick-up roller 26, to transmit the rotation of the drive shaft 20 to the pick-up roller 26 and to control the rotation transmission. The case 22 is urged by a torsion spring fitted over the drive shaft 20, such that the pick-up roller 26 is pressed against the topmost sheet P on the sheet mounting plate 12.

The drive gear 23 that rotates together with the drive shaft 20 is disposed inside the case 22 at the left upper portion thereof in FIG. 6, while surrounding the drive shaft 20. The arm member 28 is disposed on the right side of the drive gear 23 in FIG. 6. Further on the right side of the arm member 28, the sheet detecting actuator 32 is disposed.

Figure 8:
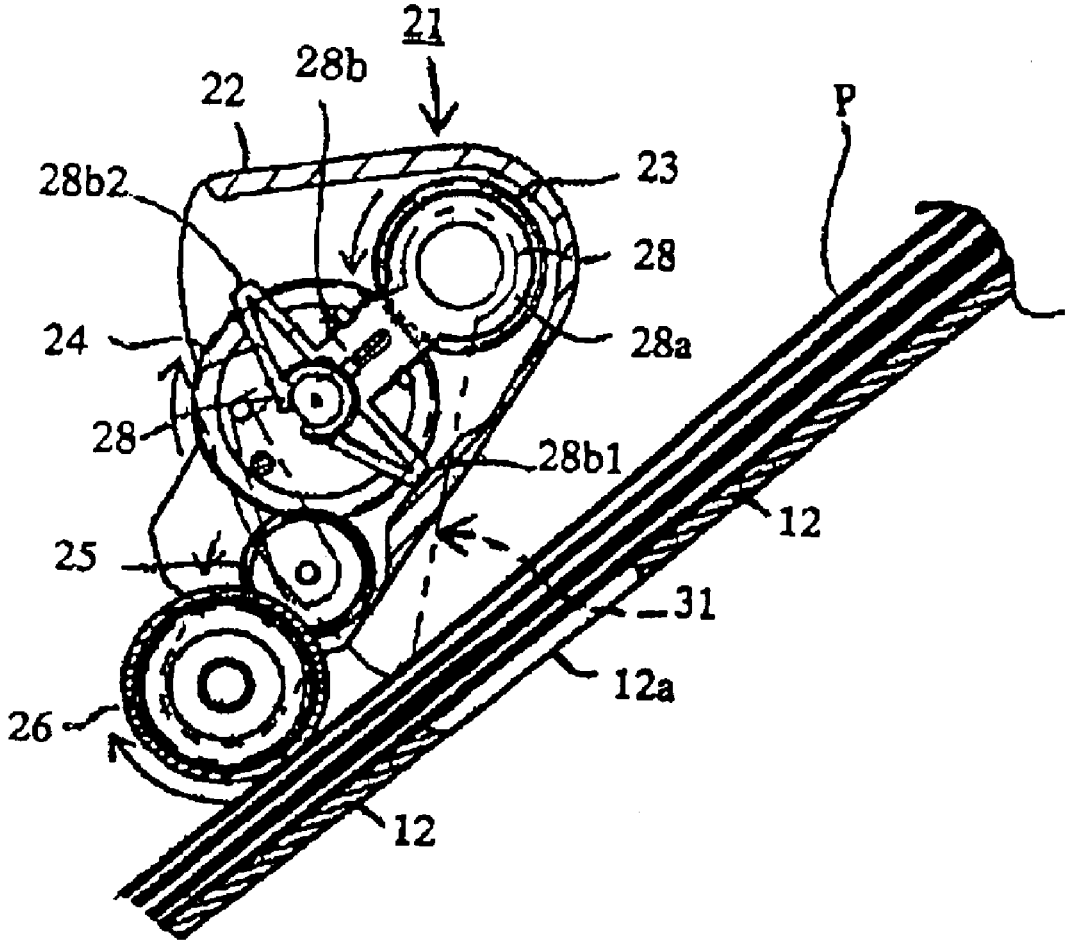
FIG. 8 is a cross-sectional side view of the pick-up roller unit during a sheet pick-up operation, with sheets mounted on a sheet mounting plate.
Figure 9:
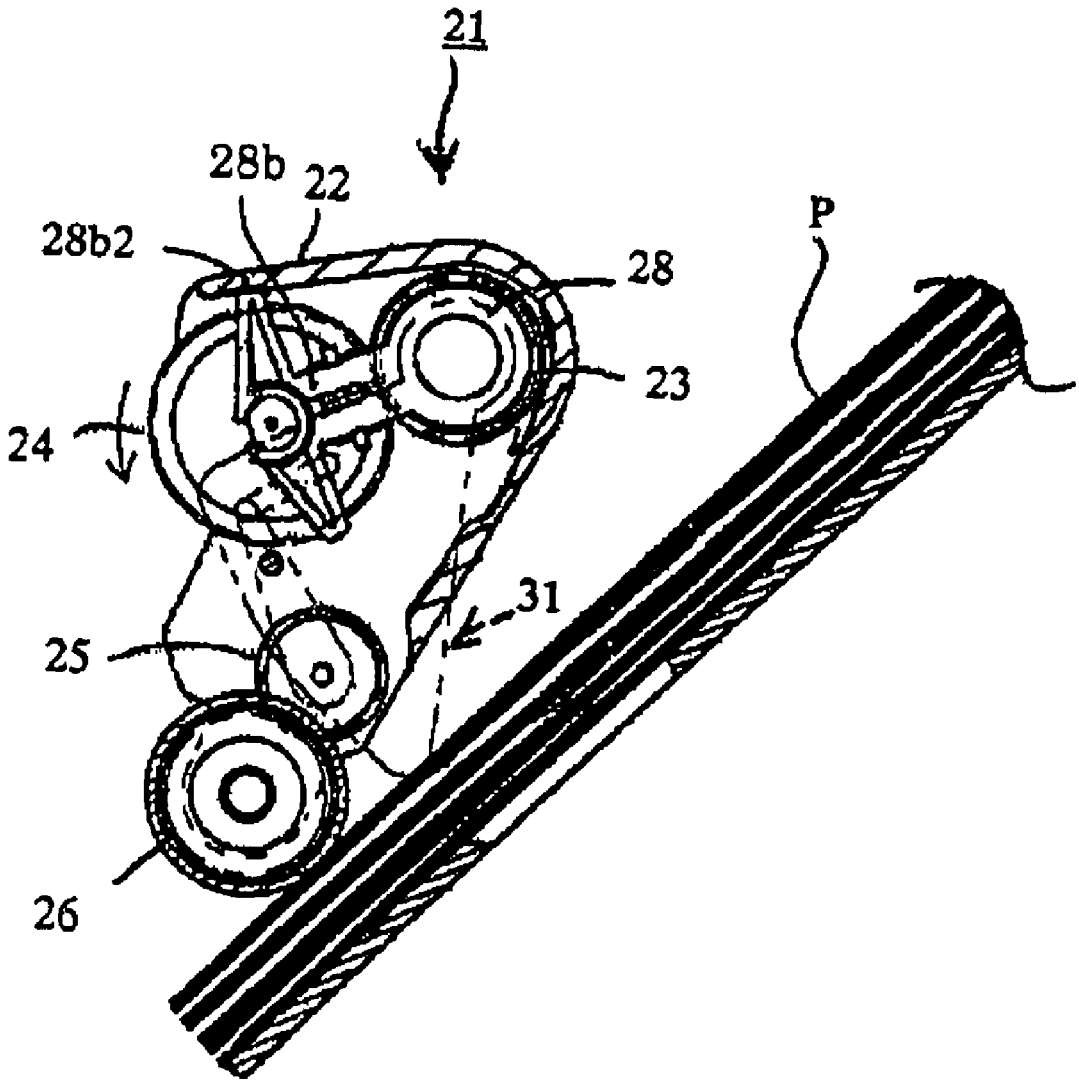
FIG. 9 is a cross-sectional side view of the pick-up roller unit during a non-sheet pick-up operation, with sheets mounted on the sheet mounting plate.

The arm member 28 is a link member that includes a collar 28*a* that rotatably receives the drive shaft 20 therein, and an arm 28*b* extending outwardly from the collar 28*a*, as shown in FIGS. 8 and 9. The clutch gear 24 that engages with the drive gear 23 is rotatably mounted on an end of the arm 28*b*.

Disposed in the case 22 at a lower portion thereof in FIG. 6 is the pick-up roller 26 having a substantially cylindrical shape for feeding the sheets P. The pick-up roller 26 includes a roller section 26*a* that contacts the sheet P and feeds the sheet P by the rotation thereof, and a gear section 26*b* that transmits the rotation of the drive shaft 20 to the roller section 26*a*. The roller section 26*a* is covered with a material having a high skin frictional resistance, such as silicone rubber, to prevent the roller section 26*a* from spinning when the roller section 26*a* makes contact with the sheet P. The interposed gear 25 is disposed between the clutch gear 24 and the gear section 26*b*, to transmit the rotation of the drive shaft 20 to the roller section 26*a*.

The clutch gear 24 moves together with the arm 28*b*, and accordingly engages with or disengages from the interposed gear 25 that engages with the pick-up roller 26.

Figure 7:
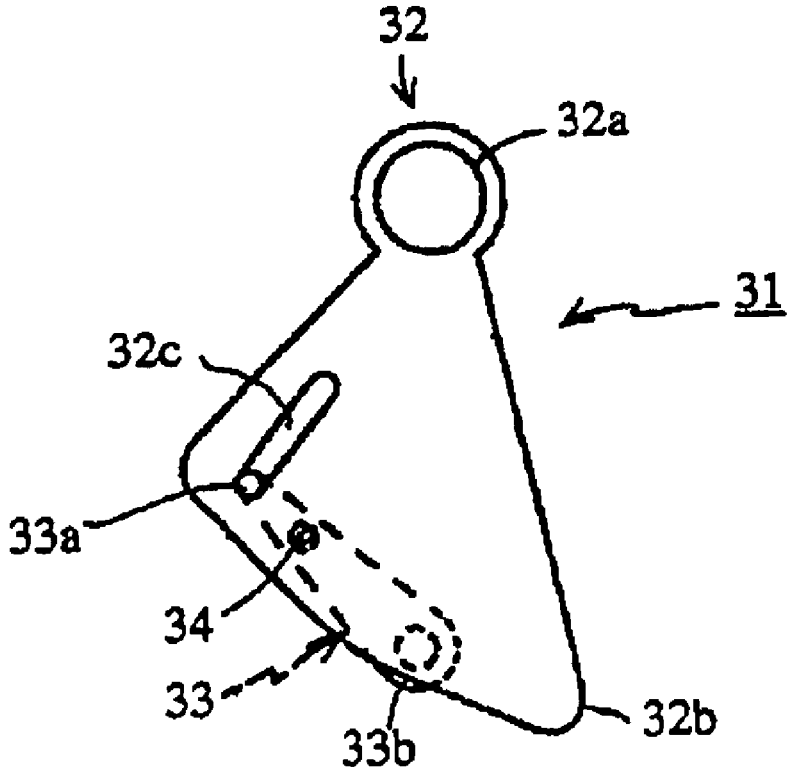
FIG. 7 is an enlarged side view of an actuator of the pick-up roller unit.

The actuator unit 31 will be described in detail with reference to FIGS. 6 and 7. As shown in FIGS. 6 and 7, the actuator unit 31 includes the sheet detecting actuator 32, a drive actuator 33, and a drive interrupting boss 34. The sheet detecting actuator 32 is fitted over the drive shaft 20 so as to pivot about a collar 32*a*. A movable end 32*b* of the sheet detecting actuator 32 presses, by its own weight, a surface of the topmost sheet P mounted on the sheet mounting plate 12. The end 32*b* moves as an amount of the sheets P on the sheet mounting plate 12 varies. The drive actuator 33 is provided with a protrusion 33*a* on one end thereof. The protrusion 33*a* is a fitting portion that is fitted into a groove 32*c* formed in the sheet detecting actuator 32. The protrusion 33*a* is slidable along the groove 32*c*. The drive actuator 33 has a collar 33*b* on the other end thereof. The collar 33*b* is rotatably supported on a shaft of the interposed gear 25, as shown in FIG. 6. The drive actuator 33 also has the drive interrupting boss 34 disposed opposite to the surface where the protrusion 33*a* is provided, that is, on the side near the arm member 28 (left side in FIG. 6). The boss 34 is structured to make contact with a stopper section 28*b*1 of the arm member 28.

The operations of the sheet feeder 10 will be described below with reference to FIGS. 8 to 11. In FIGS. 8 to 11, a pitch circle of each of the clutch gear 24 and the interposed gear 25 is indicated by dot-dash lines, and gear teeth provided on an outer periphery of each gear 24, 25 are not illustrated.

As shown in FIGS. 8 through 11, the arm 28*b* of the arm member 28 is formed into a substantially "T" shape when viewed from the side. The clutch gear 24 is rotatably supported by a shaft at an end of the arm 28*b* extending from the collar 28*a* of the arm member 28. Stopper sections 28*b*1, 28*b*2 extend outwardly, from a portion where the clutch gear 24 is supported by the shaft, in the radial direction of the gear 24, forming a substantially straight line. When the arm 28*b* of the arm member 28 rotates in the clockwise direction in FIG. 8, an end of the stopper section 28*b*2 contacts an inner surface of the case 22.

FIG. 8 shows the position of the arm 28*b* during a sheet pick-up operation, and FIG. 9 shows the position of the arm 28*b* and clutch gear 24 during a non-sheet pick-up operation. Since the movement of arm 28*b* and clutch gear 24 include the positions shown in FIGS. 8 and 9 in performing both the sheet pick-up and non-sheet pick-up operations, both FIGS. 8 and 9 are referenced in describing each operation discussed below.

During the sheet pick-up operation, the drive motor 41 shown in FIG. 5 is rotated in the clockwise direction. The drive shaft 20 is rotated in the counterclockwise direction as shown in FIG. 8, through the pinion gear 41*a*, the connecting gears 42–47, and the transmission gear 48. Together with the drive shaft 20, the drive gear 23 is rotated in the counterclockwise direction as shown in FIG. 8. Then, the rotation of the drive gear 23 is transmitted to the clutch gear 24 engaging therewith. In association with the rotation of the drive gear 23, the clutch gear 24 pivotally moves from the position shown in FIG. 9, toward the interposed gear 25 about the drive shaft 20, together with the arm 28*b* of the arm member 28. In other words, the clutch gear 24 rotates in the counterclockwise direction as shown in FIG. 9. Accordingly, the clutch gear 24 is moved to engage with the interposed gear 25, as shown in FIG. 8. Thus, the rotation of the clutch gear 24 is transmitted to the interposed gear 25. Further, the rotation of the interposed gear 25 is transmitted to the gear section 26*b* of the pick-up roller 26. Consequently, the roller section 26*a* is rotated in the clockwise direction as shown in FIG. 8 and the sheet P is fed by the pick-up roller 26.

The clutch gear 24 is positioned opposite to the sheet mounting plate 12 with respect to the interposed gear 25 (the left upper side of the interposed gear 25 in FIG. 8). As the clutch gear 24 is rotated, after engaging with the interposed gear 25, by the rotation of the drive gear 23, the arm member 28 tends to move further in the counterclockwise direction in FIG. 8, due to the rotating force of the drive gear 23. Accordingly, the pick-up roller unit 21 is moved in the direction to press the sheet mounting plate 12. With the movement of the pick-up roller unit 21 toward the sheet mounting plate 12, the pick-up roller 26 is prevented from moving away from the sheets P on the sheet mounting plate 12 when the pick-up roller 26 feeds the sheets P. Thus, the sheets P may be smoothly fed by the pick-up roller 26.

During the non-sheet pick-up operation, the drive motor 41 shown in FIG. 5 is rotated in a counterclockwise direction which is opposite to that when the pick-up roller 26 picks up and feeds the sheets P. The drive force from the motor 41 is transmitted to the drive shaft 20, through the pinion gear 41*a*, the connecting gears 42–47, and the transmission gear 48, to rotate the drive shaft 20 clockwise as shown in FIG. 9. Together with the rotating drive shaft 20, the drive gear 23 is rotated clockwise as shown in FIG. 9. The rotation of the drive gear 23 is transmitted to the clutch gear 24 engaging therewith. In association with the rotation of the drive gear 23, the clutch gear 24 pivotally moves from the position shown in FIG. 8 about the drive shaft 20, together with the arm 28*b* of the arm member 28 in the clockwise direction as shown in FIG. 8. Accordingly, the clutch gear 24 moves away from the interposed gear 25, to disengage therefrom, as shown in FIG. 9. Thus, the drive force is not transmitted to the pick-up roller 26.

As the arm member 28 moves in the clockwise direction starting from the position shown in FIG. 8, the end of the stopper section 28*b*2 contacts the inner surface of the case 22 as shown in FIG. 9. Thus, the movements of the arm member 28 and the clutch gear 24 in the clockwise direction may be restricted. As the drive shaft 20 is further rotated in the clockwise direction with the end of the stopper section 28*b*2 contacting the inner surface of the case 22, the arm member 28 pushes the case 22 upwardly with the stopper section 28*b*2 by the rotating force of the drive gear 23. Accordingly, the case 22 is pivotally moved about the drive shaft 20 in the clockwise direction, to move the pick-up roller 26 away from the sheet mounting plate 12.

As described above, the sheets P mounted on the sheet mounting plate 12 are picked up and fed smoothly one by one with the pick-up roller 26.

Figure 10:
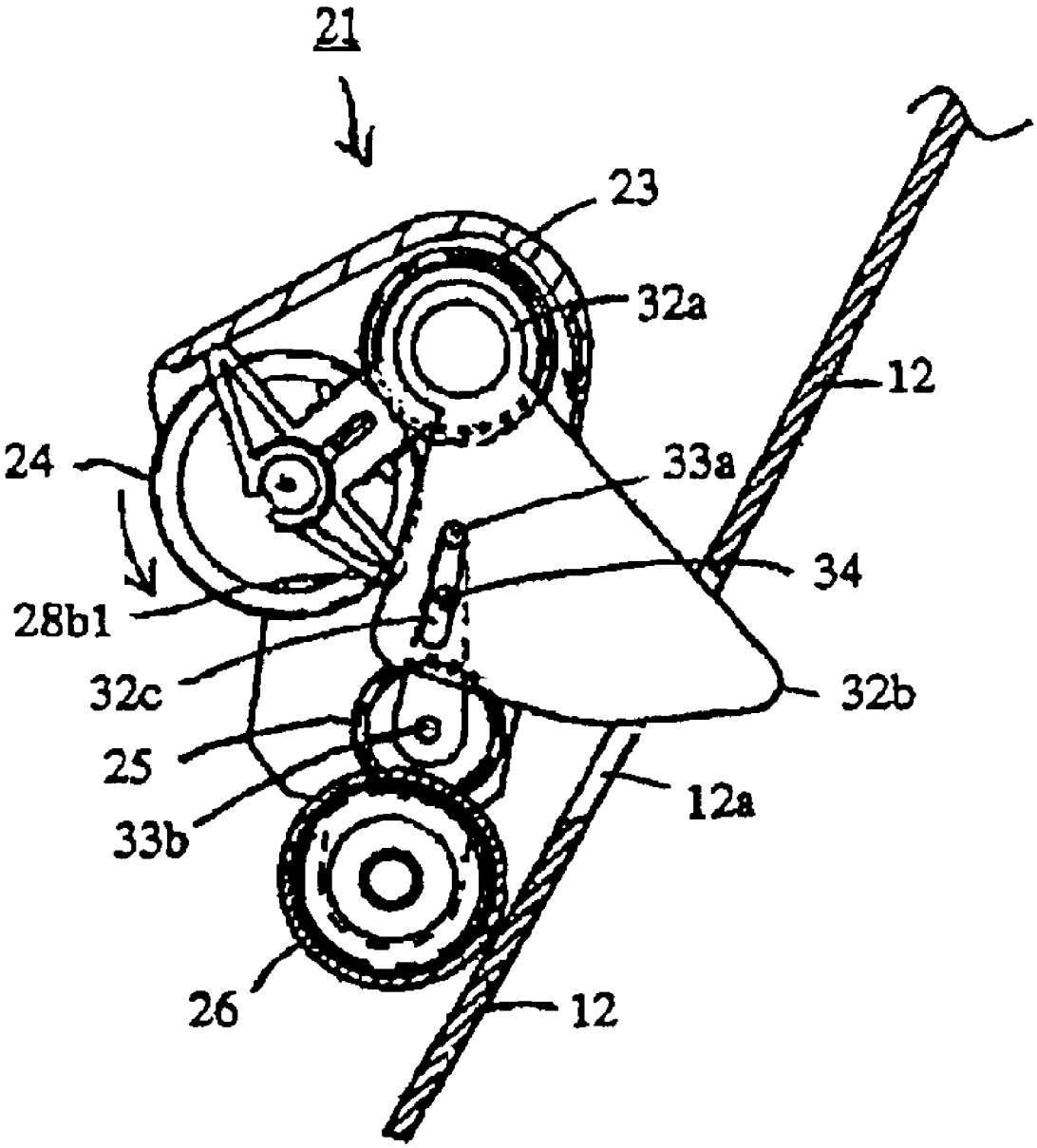
FIG. 10 is a cross-sectional side view of the pick-up roller unit during the non-sheet pick-up operation with no sheets mounted on the sheet mounting plate.
Figure 11:
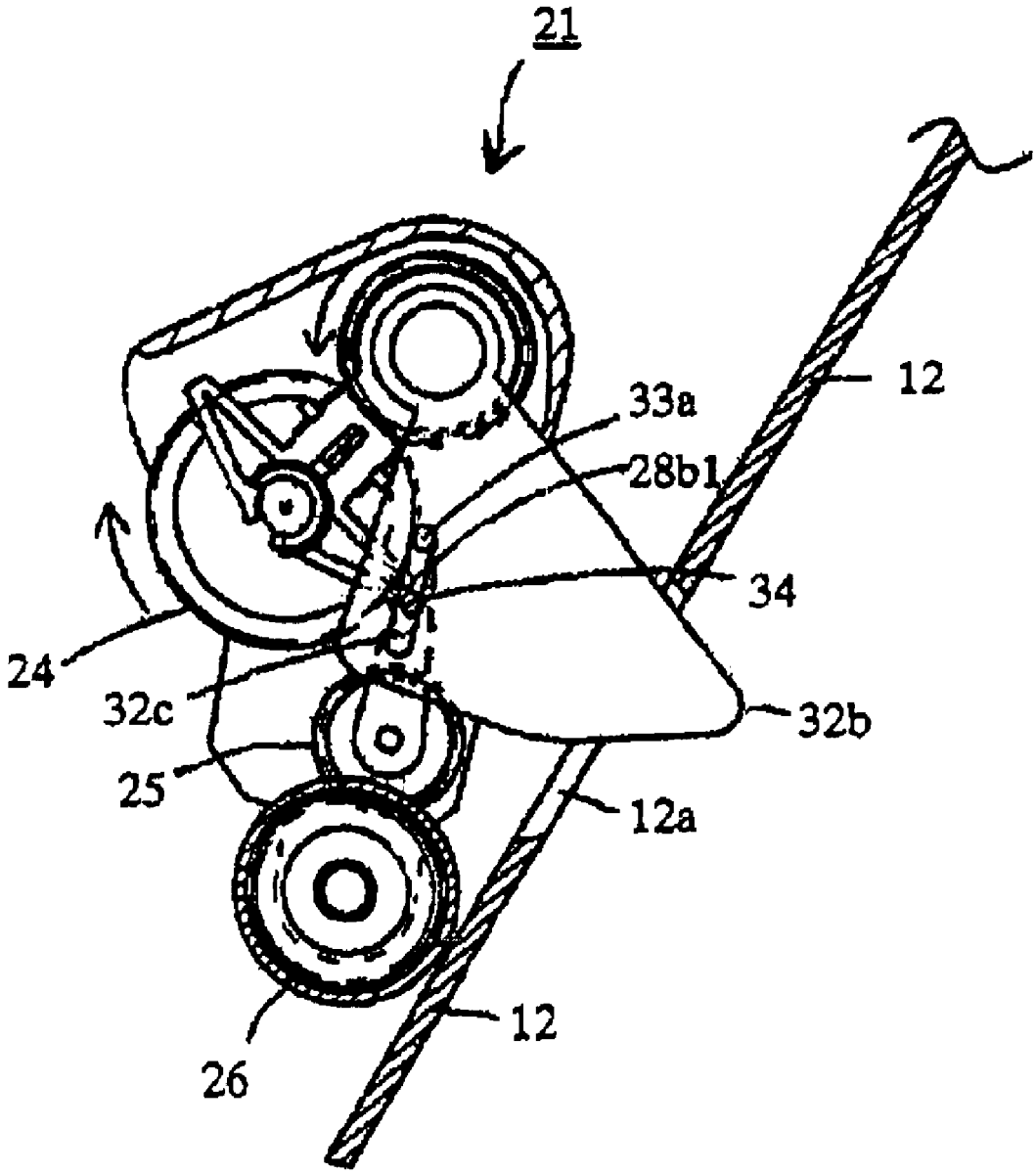
FIG. 11 is a cross-sectional side view of the pick-up roller unit during the sheet pick-up operation, with no sheets mounted on the sheet mounting plate.

The operation of the actuator unit 31 and the pick-up roller unit 21 when the last sheet P on the sheet mounting plate 12 is fed, will be described with reference to FIGS. 10 and 11.

The weight of the sheet detecting actuator 32 always presses against the sheets P on the sheet mounting plate 12 during the non-sheet pick-up operation. When the non-sheet pick-up operation is performed with the sheets P mounted on the sheet mounting plate 12, the drive interrupting boss 34 is in a position other than a path of the stopper section 28*b*1, as shown in FIG. 9, due to the sheets P mounted on the sheet mounting plate 12. As the sheets P run out, the weight of the sheet detecting actuator 32 moves the sheet detecting actuator, as shown in FIG. 10, with the end 32*b* fitting into the opening 12*a* formed in the sheet mounting plate 12. The protrusion 33*a* provided at an end of the drive actuator 32 fits into the groove 32*c* of the sheet detecting actuator 32, so that, as the sheet detecting actuator 32 moves, the protrusion 33*a* pivots about the collar 33*b* along the groove 32*c* and the drive interrupting boss 34 moves to a position on the path of the stopper section 28*b*1.

As the drive shaft 20 is rotated counterclockwise in order for the sheet feeder 10 to perform the sheet feeding operation with no sheets P mounted on the sheet mounting plate 12, the arm member 28 moves in the counterclockwise direction according to the rotation of the drive shaft 20 in the counterclockwise direction. The clutch gear 24 tends to engage with the interposed gear 25. However, as shown in FIG. 11, the drive interrupting boss 34 contacts the stopper section 28*b*1, so that engagement of the clutch gear 24 and the interposed gear 25 is interrupted. Accordingly, the drive force from the drive motor 41 is not transmitted to the pick-up roller 26. The boss acts as a type of maintaining device to maintain the separated condition until the sheets P are mounted on the sheet mounting plate 12.

As described above, in the sheet feeder 10 according to the embodiment, when the sheets P on the sheet mounting plate 12 run out, the sheet detecting actuator 32 fits into the opening 12*a* formed in the sheet mounting plate 12. Accordingly, the drive actuator 33 and the drive interrupting boss 34 move so as to interrupt the transmission of the drive force to the pick-up roller 26.

With the above-described structures, application of the excessive rotating force to the drive shaft 20, the gears 23–25 and the pick-up roller 26 may be prevented. Accordingly, the damages on the drive shaft 20, the gears 23–25, and the pick-up roller 26 may be prevented. In addition, application of excessive loads to the drive motor 41 and the connecting gears 42–47 may be prevented by freely rotating the transmission gear 48 relative to the drive shaft 20. Therefore, noises generated when the drive motor 41 is in abnormal driving conditions, as well as malfunction of the motor 41, may be prevented.

The sheet feeder 10 according to the embodiment may include a switching device that makes a switch between a first condition where a drive force from the drive motor 41 is transmittable, that is, a drive condition during the sheet pick-up condition, and a second condition where the drive force from the drive motor 41 is not transmittable, that is, a drive condition during the non-sheet pick-up condition. A mechanism of transmitting the drive force from the interposed gear 25 to pick-up roller 26 may constitute a first drive force transmission device. A mechanism of transmitting the drive force from the drive motor 41 to the drive gear 23, through the pinion gear 41*a*, the connecting gears 42–47, the transmission gear 48, and the drive shaft 20 may constitute a second drive force transmission device. In addition, the sheet feeder 10 according to the embodiment may include a maintaining device that maintains a disengagement condition between the clutch gear 24 and the interposed gear 25 with the drive interrupting boss 34, according to the movement of the actuator unit 31.

While the invention has been described with reference to the embodiment, it is to be understood that the invention is not restricted to the particular forms shown in the foregoing exemplary embodiment. Various modifications and alterations can be made thereto without departing from the scope of the invention, as set forth in the appended claims.

For example, an actuator may be provided on the sheet mounting surface 121 together with a spring member. When the sheets P are mounted on the sheet mounting plate 12, the actuator may be pressed by the sheets P by the weights of the sheets P. When no sheets P are mounted on the sheet mounting plate 12, the actuator may spring away from the sheet mounting surface 121 to raise the pick-up roller unit 21 upwardly, and consequently, to move the pick-up roller 26 away from the sheet mounting plate 12.

Figure 12:
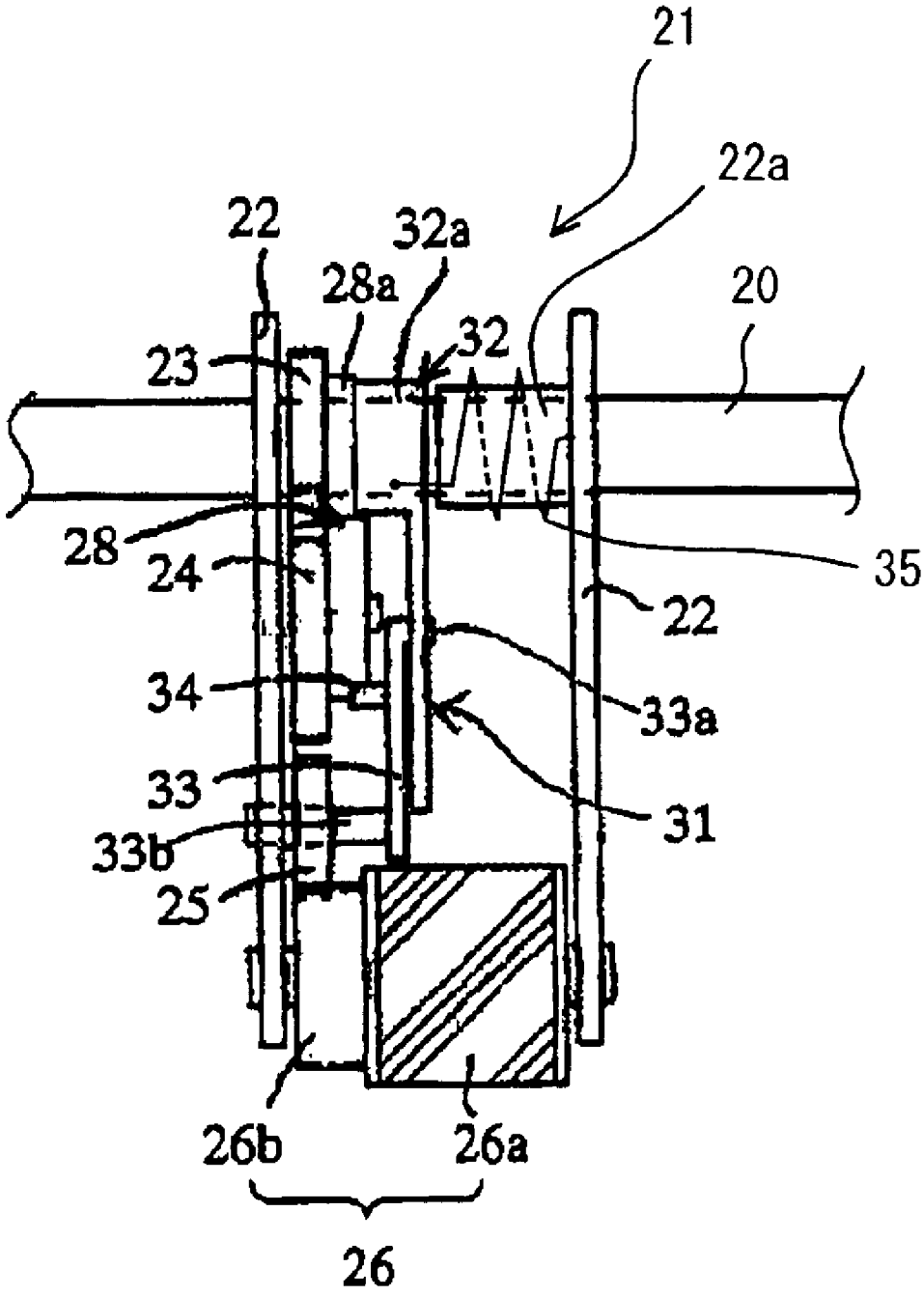
FIG. 12 is a front view of the pick-up roller unit, including a spring member, illustrating internal structures thereof.

In the above-described embodiment, the weight of the sheet detecting actuator 32 presses against the sheets P on the sheet mounting plate 12. Instead, as shown in FIG. 12, a spring member 35 with a low spring force may be provided to stabilize the movement of the sheet detecting actuator 32. The spring member 35 may be a coil spring. One end of the spring member 35 may be connected to the collar 22*a* of the case 22, and another end of the spring member 35 may be connected to the collar 32*a* of the actuator 32. The spring member 35 may support the sheet detecting actuator 32 to press the sheets P on the sheet mounting plate 12. Preferably, the spring force of the spring member may be about 2 to 5 g.

What is claimed is:

1. A sheet feeder, comprising:

a sheet mounting plate that mounts sheets thereon;

a pick-up roller provided so as to face the sheet mounting plate, the pick-up roller picking up and feeding one sheet at a time from the sheets mounted on the sheet mounting plate by rotating the pick-up roller when the pick-up roller and the sheet contact each other;

a drive motor that generates a drive force; and a transmission device that transmits the drive force from the drive motor to the pick-up roller, the transmission device including:

a first drive force transmission device that constantly cooperates with a rotation shaft of the pick-up roller;

a switching device that makes a switch between a first condition where a drive force from the drive motor is transmittable to the first drive force transmission device and a second condition where the drive force from the drive motor is not transmittable to the first drive force transmission device;

a second drive force transmission device that transmits the drive force from the drive motor to the switching device; and an actuator that moves in accordance with a presence or an absence of the sheets on the sheet mounting plate, the actuator setting the switching device in the second condition when none of the sheets are mounted on the sheet mounting plate.

2. The sheet feeder according to claim 1, wherein the switching device includes:

a first gear that receives from the second drive force transmission device the drive force transmitted from the drive motor;

a link member that rotatably supports the first gear on one end thereof, the link member being rotatable, in association with rotation of the first gear, in a same direction as the rotation of the first gear; and a second gear that is rotatably supported on the other end of the link member and to which the drive force from the first gear is transmitted, the second gear engaging with the first drive force transmission device in the first condition to transmit the drive force to the first drive force transmission device and being separated from the first drive force transmission device in the second condition, and the actuator includes a maintaining device that maintains a condition where the second gear is separated from the first drive force transmission device by restricting the link member when none of the sheets are mounted on the sheet mounting plate.

3. The sheet feeder according to claim 1, wherein the actuator includes:

a sheet detecting actuator that detects the presence or absence of the sheets on the sheet mounting plate; and a drive actuator that operates, in association with the sheet detecting actuator, to set the switching device in the second condition.

4. The sheet feeder according to claim 3, wherein the sheet detecting actuator is pivotally supported about an axis disposed above the center of gravity of the actuator, and the sheet detecting actuator has an end that presses the weight of the sheet detecting actuator against an uppermost surface of the sheets mounted on the sheet mounting plate and that moves in accordance with an amount of the sheets on the sheet mounting plate.

5. The sheet feeder according to claim 4, wherein the sheet mounting plate has an opening, at a portion facing the sheet detecting actuator, for inserting the end of the sheet detecting actuator therein.

6. The sheet feeder according to claim 4, wherein the sheet detecting actuator is fitted over a drive shaft of the second drive force transmission device and is pivotally supported about the drive shaft.

7. The sheet feeder according to claim 3, wherein the actuator has a groove formed on one of the drive actuator and the sheet detecting actuator, and a fitting portion that is provided on the other one of the drive actuator and the sheet detecting actuator and slidably fits in the groove, and through the groove and the fitting portion, a pivotal movement of the sheet detecting actuator is transmitted to the drive actuator and associated therewith.

8. The sheet feeder according to claim 3, wherein the switching device includes:

a first gear that receives from the second drive force transmission device the drive force transmitted from the drive motor;

a link member that rotatably supports the first gear on one end thereof, the link member being rotatable, in association with rotation of the first gear, in a same direction as the rotation of the first gear; and a second gear that is rotatably supported on the other end of the link member and to which the drive force from the first gear is transmitted, the second gear engaging with the first drive force transmission device in the first condition to transmit the drive force to the first drive force transmission device and being separated from the first drive force transmission device in the second condition, and the drive actuator of the actuator includes a maintaining device that maintains a condition where the second gear is separated from the first drive force transmission device by restricting the link member when none of the sheets are mounted on the sheet mounting plate.

9. The sheet feeder according to claim 8, wherein the maintaining device of the drive actuator is a boss that maintains a condition where the second gear is separated from the first drive force transmission device by directly contacting the link member and the boss moves in association with the pivotal movement of the sheet detecting actuator.

10. The sheet feeder according to claim 9, wherein the link member includes a stopper that extends toward the rotating direction of the link member, and the stopper and the maintaining device of the drive actuator contact each other to maintain a condition where the second gear is separated from the first drive force transmission device.

11. The sheet feeder according to claim 3, wherein the sheet detecting actuator includes a spring member to press the sheets on the sheet mounting plate.

12. The sheet feeder according to claim 11, wherein the spring member has a spring force of about 2 to 5 g.

* * * * *